United States Patent [19]

Baba

[11] Patent Number: 5,027,484

[45] Date of Patent: Jul. 2, 1991

[54] TENSION CONTROLLER FOR WARPING MACHINE AND WARPING METHOD

[75] Inventor: Yoshihiro Baba, Osaka, Japan

[73] Assignee: Baba Sangyo Kikai Co., Ltd., Osaka, Japan

[21] Appl. No.: 471,836

[22] Filed: Jan. 29, 1990

[30] Foreign Application Priority Data

Jan. 31, 1989 [JP] Japan ..... 1-22927

[51] Int. Cl.[5] ..... D02H 13/14

[52] U.S. Cl. ..... 28/185; 28/194

[58] Field of Search ..... 28/172, 185, 194, 245

[56] References Cited

U.S. PATENT DOCUMENTS 4,819,310 4/1989 Beerli et al. ..... 28/185
4,916,783 4/1990 Hagewood et al. ..... 28/172

FOREIGN PATENT DOCUMENTS 12235 6/1980 European Pat. Off. ..... 28/185
3206272 9/1983 Fed. Rep. of Germany ..... 28/185
61-275436 12/1986 Japan .
62-238838 10/1987 Japan .

*Primary Examiner*—Werner H. Schroeder
*Assistant Examiner*—John J. Calvert
*Attorney, Agent, or Firm*—W. G. Fasse; D. H. Kane, Jr.

[57] ABSTRACT

A tension controller for a warping machine maintains a constant yarn tension during a warping operation from the beginning to the end of the warping operation. The tension controller has a brake force control mechanism (240) for controlling the size of the tension applied to the running yarns, and a yarn speed control mechanism (290) for controlling the running speed of the yarns. The brake control input, which is supplied to the yarns brakes, and the running speed of the yarns are so controlled that the actual yarn tension conforms to set or desired tension. When the diameters of the yarn packages are relatively large, a brake force is applied to the yarns, which run at a constant speed, thereby maintaining a constant yarn tension. When the diameters of the yarn packages are relatively small, on the other hand, a constant yarn tension is maintained by reducing the running speed of the yarns while supplying a zero or constant brake force to the yarns.

10 Claims, 8 Drawing Sheets

TENSION CONTROLLER FOR WARPING MACHINE AND WARPING METHOD

FIELD OF THE INVENTION

The present invention relates to a tension controller for a warping machine such as a beam warper, a drum warper or the like. The invention also relates to a warping method.

DESCRIPTION OF THE BACKGROUND ART

BACKGROUND INFORMATION

Warping machines and sizing machines are known as machines for preparing yarns for weaving. A warping machine is adapted to systematically arrange a number of yarns which are drawn out from a number of packages held by creels and wind the same on a warper's beam or drum. A sizing machine is adapted to size warps which are drawn out from a number of warper's beams, dry and wind the same on a sizing beam.

In general, natural or blended yarns are prepared for a weaving process through a warping process and a sizing process. Synthetic yarns may be directly brought into the weaving process through the warping process with no sizing.

The warping operation is adapted to arrange a number of warps in parallel with each other for making a woven fabric, and hence it is most important to maintain a uniform tension of the yarns which are wound on the warper's beam or drum. To this end, various types of tension controllers have been recently proposed for maintaining a constant tension of the yarns in the warping operation.

Japanese Patent Publication (Laying-Open No. 62-238838, Application No. 62-82188) with a claim of priority based on Swiss patent application No. 1286/86-8, discloses a technique which is of interest to the present invention. Japanese Patent Publication No. 62-238838 also corresponds to U.S. Pat. No. 4,819,310. FIG. 1 of the above publication illustrates a tension controller for a drum warper. A number of yarns 103 are drawn out from a number of bobbins 102, which are held by a creel 101, and wound on a warper's drum 107 by a brake force supplier 104, a measuring roller 105 and a deflection roller 106. The measuring roller 105 measures the total tension of the number of yarns 103 passing through the same. The brake force supplier 104 supplies the running yarns 103 with a running resistance, i.e., brake force, thereby increasing the yarn tension. In order to maintain a constant tension of the running yarns 103, the brake control input of the brake force supplier 104 is adjusted in response to the actual yarn tension which is detected by the measuring roller 105. The yarns 103 are driven to run at a constant speed.

Even if the brake control input of the brake force supplier 104 is zero, the running yarns 103 are subjected to tension, which is caused by the release resistance in relation to the bobbins 102 and the air resistance against the running yarn.

The inventor has examined the relationship between changes of a package diameter and the yarn tension. FIG. 2 shows on the ordinate the yarn tension (g) or changes thereof caused when cotton yarns of count No. 40 were drawn out from parallel packages at a speed of 800 m/min, as a function of the package diameter (mm) plotted on the abscissa. As understood from FIG. 2, the yarn tension is lowered with as the package diameter is reduced in the first half where the package diameter is large. In the second half of FIG. 2 where the package diameter is small, on the other hand, the yarn tension is increased as the package diameter is further reduced to reach the maximum value immediately before the packages are used up.

Due to the relation between the package diameter and yarn tension shown in FIG. 2, it is impossible to maintain a constant yarn tension from beginning to end of the warping operation, by using the tension controller disclosed in the above mentioned Japanese Patent Publication No. 62-238838. It is assumed here that the yarn tension is set at 20 g in FIG. 2, for example. In that case, the brake force supplier 104 supplies the yarns with tension $T_1$, which is evaluated by subtracting yarn tension $T_0$ in the case of a zero brake control input from the set tension (20 g). The brake force supplier 104 is adapted to apply tension to the running yarns, but is not able to reduce the yarn tension which is caused by a release resistance in relation to the package diameters and air resistance against the running yarn. Referring to FIG. 2, therefore, it is possible to control the actual yarn tension to the set tension to conform by adjusting the brake control input by the brake force supplier 104 until the package diameter is about 45 mm. When the package diameter falls below about 45 mm, however, the actual yarn tension is inevitably increased beyond the set tension even if the brake control input by the brake force supplier 104 is zero.

With reference to FIG. 2, the set tension may be so selected as to maximize the yarn tension $T_0$ which is caused by the release resistance in relation to the packages and by air resistance against the running yarn, i.e., at about 23 g. In order to select the set tension at such a value, however, it is necessary to considerably increase the brake control input of the brake force supplier 104. In other words, excessive tension $T_2$ is regularly applied to the running yarns. Hence, the yarns are weakened and frequently breakage or disconnection of the yarn occurs.

Thus, it is extremely difficult to maintain a constant yarn tension from beginning to end of the warping operation by the tension controller disclosed in Japanese Patent Publication No. 62-238838, i.e., a tension controller which adjusts the tension applied to the yarns only by the brake control input to the brake force supplier.

SUMMARY OF THE INVENTION

It is an object of the present invention to provide a tension controller for a warping machine, which can maintain a constant tension of the running yarns from the beginning to the end of the warping operation.

Another object of the present invention is to provide a tension controller for a warping machine, which can maintain the brake control input by a brake force supplier at a relatively low level.

Still another object of the present invention is to provide a warping method which can maintain a constant tension of the running yarns from the beginning to the end of the warping operation.

The tension controller for a warping machine according to the present invention, comprises brake force supply means, tension measuring means, set tension storage means, tension comparing means, brake control input judging means, brake force control means and yarn speed control means. The brake force supply means applies a brake force to the running yarns within a predetermined range of brake control input values to increase the yarn tension. The tension measuring means measures the actual tension of the running yarns. The set tension storage means stores received information representing a set or desired tension for the yarns. The tension comparing means compares the actual yarn tension measured by the tension measuring means with the set or desired yarn tension stored in the set tension storage means. The brake control input judging means judges or determines whether or not the actual brake control input by the brake force supply means, has reached a value within the limits of the predetermined range. The brake force control means controls the value of the brake control input by the brake force supply means, to remove a difference between the actual yarn tension and the set yarn tension in response to a comparing made by the tension comparing means showing that the actual yarn tension is different from the set yarn tension and to a determination made by the brake control input judging means indicating that the actual brake control input has not yet reached the limit. Thus, the yarn speed control means controls the yarn running speed to remove the difference between the actual yarn tension and the set yarn tension.

In the warping method according to the present invention, the brake force is applied to the running yarns to conform the actual yarn tension to a predetermined set yarn tension. When it is impossible to conform the actual yarn tension to the set yarn tension with only the brake force, the yarn running speed is so controlled that the actual yarn tension to the set tension conforms.

In one aspect of the present warping method, a constant yarn tension is maintained by applying a brake force to the yarns to run at a constant speed when the package diameter is relatively large. When the package diameter is relatively reduced as the warping progresses, the yarn running speed is reduced while applying no brake force or constant brake force to the yarns.

On the one hand according to the present invention, the yarn tension is adjusted only by the brake operation if the tension of running yarns can be conformed to a predetermined set tension only by a respective operation of the brake force supply means. On the other hand, if the yarn tension cannot be conformed to the predetermined set tension only by the operation of the brake force supply means, the yarn tension is conformed to the predetermined set tension by adjusting the yarn running speed. Therefore, the yarn tension can be maintained at a relatively low level as compared with the conventional tension controller which controls the yarn tension only by the operation of the brake force supplier. Thus, it is possible to reduce the frequency of breakage or disconnection in the warping and during subsequent steps without lowering yarn strength by an excessive yarn tension. Further, a constant yarn tension can be maintained from the beginning to the end of the warping operation. In addition, the yarns can be uniformly wound at the set tension without reference to the material and thickness of the yarns, the size of the packages, the speed for winding the yarns and the like. Thus, skill is not required for driving the warping machine, and uniform warper's beams can be obtained at a high quality without personal errors caused by operators.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
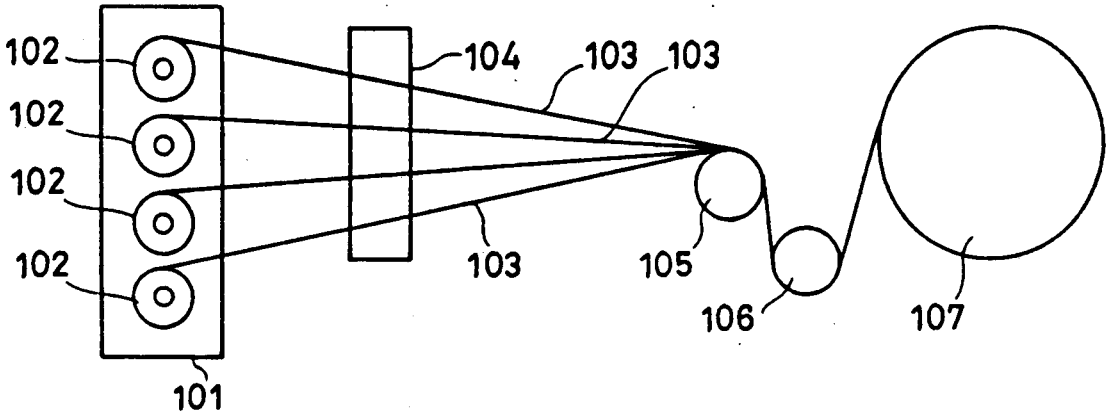
FIG.1 PRIOR ART
FIG. 1 illustrates a tension controller for a warping machine, as disclosed in a Japanese Patent Publication No. 62-238838.
Figure 2:
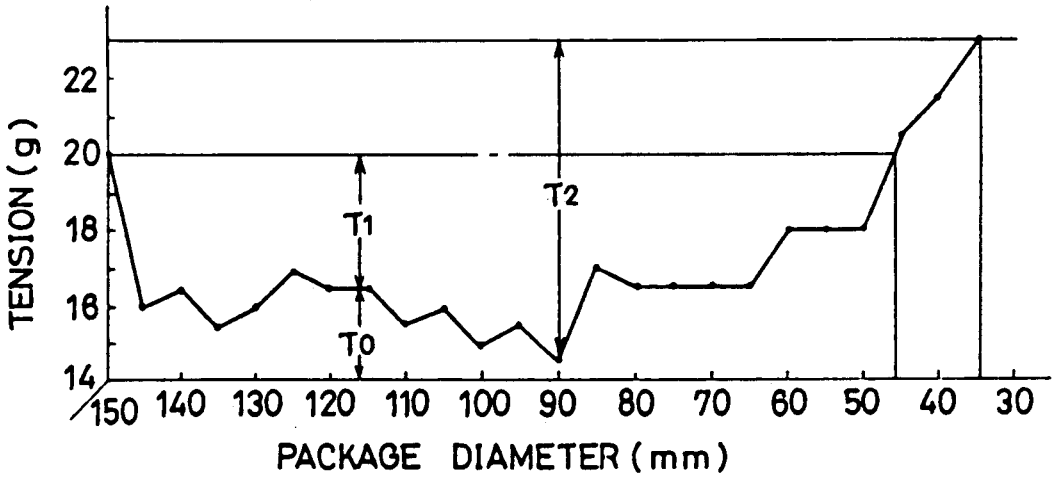
FIG. 2 illustrates the result of an examination of the relationship between the package diameter and the yarn tension.
Figure 3:
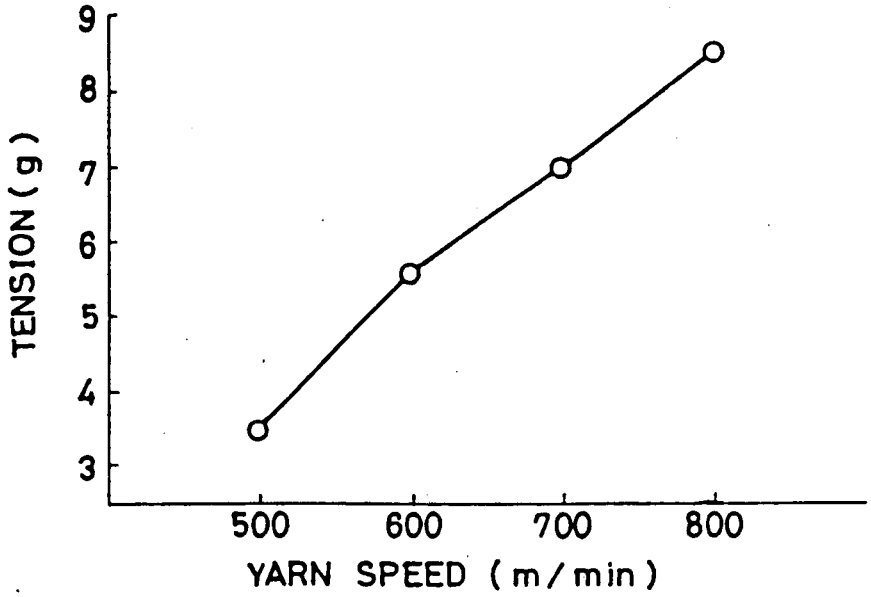
FIG. 3 illustrates the result of an examination of the relationship between the yarn running speed and the yarn tension.

The inventor has made a test by changing the running speed of yarns, which were drawn out from packages and wound on a warper's beam, without any application of a brake force to the yarns, for measuring changes in the yarn tension. FIG. 3 shows the result of the measurements made during the test. The horizontal axis shows the running speed of the yarns, and the vertical axis shows the yarn tension. The test was made with parallel packages of cotton yarns of count No. 20. As understood from FIG. 3, the yarn tension increases substantially proportionately to an increase in the yarn running speed. The inventor has noted this phenomenon, to achieve the present invention.

Figure 4:
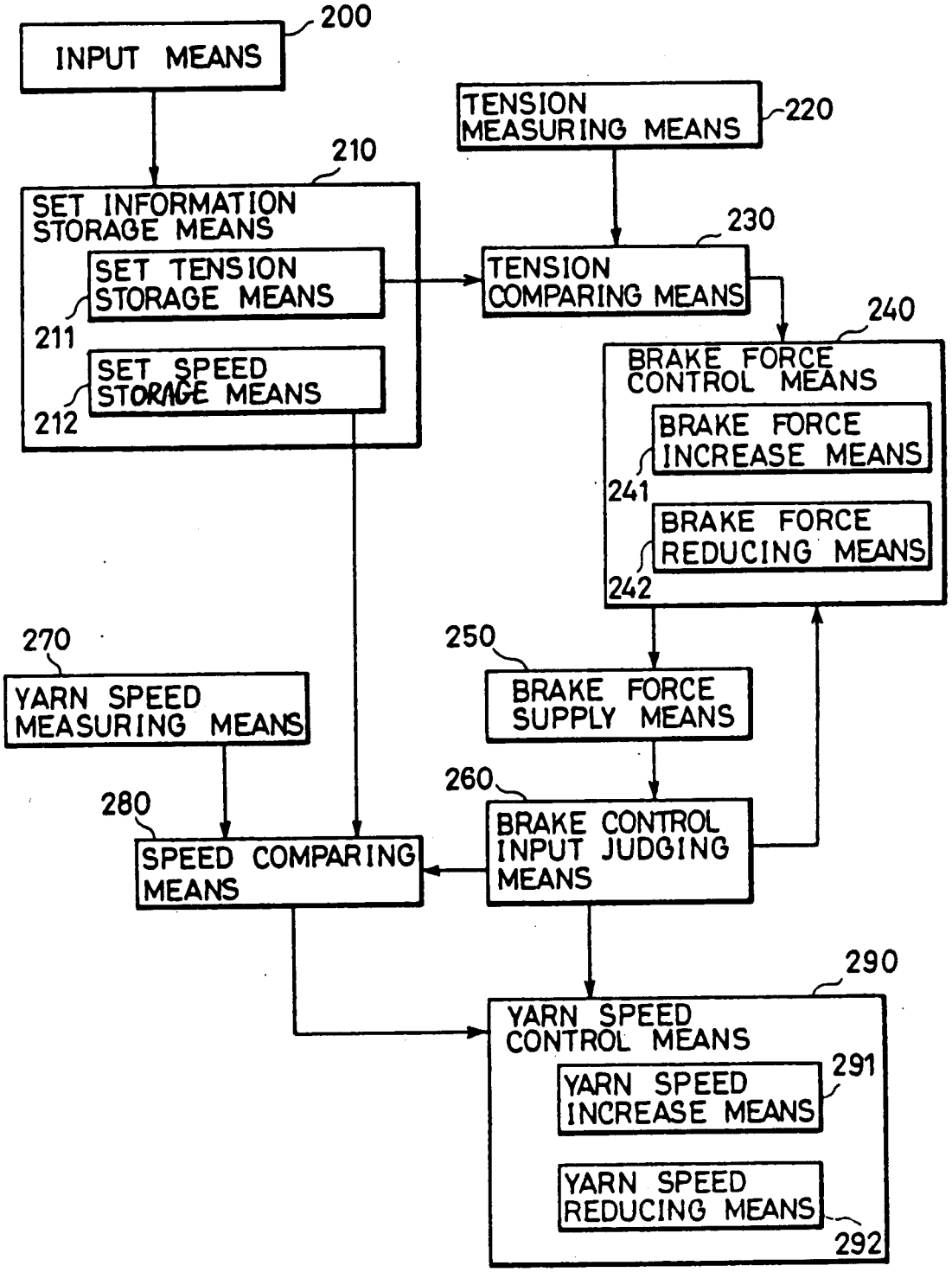
FIG. 4 is a block diagram showing an embodiment of the yarn tension control of the present invention.

FIG. 4 is a schematic block diagram showing a tension controller for a warping machine according to an embodiment of the present invention. Referring to FIG. 4, the present tension controller comprises input means 200 for inputting control information information storage means 210 for storing information representing a set or desired yarn tension, tension measuring means 220, tension comparing means 230 for comparing a set tension with a measured tension to provide a yarn tension difference signal, brake force control means 240, brake force supply means 250, brake control input judging means 260 for providing a brake control reference signal, yarn speed measuring means 270, speed comparing means 280 for providing a speed difference signal, and yarn speed control means 290. The present tension controller maintains a constant tension of a number of running yarns, which are drawn out from a number of packages held by creels, in a warping operation for systematically arranging the yarns and winding the same on a warper's beam or drum.

The brake force supply means 250 applies a controlled brake force to the running yarns which are drawn out from the packages i.e., to cause a running resistance or an additional tension, within a range predetermined by the control input, to increase the yarn tension. The brake force supply means 250 may be formed by means which can simultaneously supply the brake force to a number of yarns. For example, the brake force supply means 250 can be formed by a tension washer which is pressed by springs, or a bar tension mechanism which is provided with a plurality of parallel bars for changing the degree of bending of the yarns by moving an intermediately positioned bar. The tension added to the yarns is increased or decreased in response to an increase or decrease of the control input of the brake force supply means 250. Even if the control input by the brake force supply means 250 is zero, the running yarns are subjected to tension which is caused by the release resistance by the yarns against being pulled out of the packages and by air resistance against the running yarns, as hereinabove described.

The tension measuring means 220 measures the actual yarn tension of the running yarns. More specifically, the tension measuring means 220 measures the total or average tension of the overall yarns which are wound on the warper's beam of a beam warper or the drum of a drum warper. This tension measuring means 220 is preferably a detecting roller contacting the yarns to angularly bend passages thereof for detecting the pressure applied to this detecting roller.

Set or desired information as to the number of the yarns to be warped, the desired yarn tension, the desired yarn speed, an initial brake control input and the like are inputted through the input means 200 and stored in the information storage means 210. The set information storage means 210 comprises set tension storage means 211 for storing the received information of the set yarn tension and set speed storage means 212 for storing the received information of the set yarn running speed.

The tension comparing means 230 compares the actual yarn tension measured by the tension measuring means 220 with the set yarn tension stored in the set tension storage means 211.

The brake control input judging means 260 judges whether or not the actual brake control input by the brake force supply means 250 has reached a limit within a predetermined range.

The brake force control means 240 controls the brake control input to the brake force supply means 250 for removing a difference between the actual yarn tension and the set or desired yarn tension in response to the output of the tension comparing means 230 indicating that the actual measured yarn tension is different from the set yarn tension and in response to an output from the brake control input judging means 260 that the actual brake control input has not yet reached the required limit. This brake force control means 240 comprises brake force increase means 241 for increasing the brake control input if the actual tension is smaller than the set tension, and brake force reducing means 242 for reducing the brake control input if the actual tension is larger than the set tension.

The yarn speed control means 290 controls the yarn running speed to remove a difference between the actual yarn tension and the set yarn tension in response to a recognition made by the tension comparing means 230 that the actual yarn tension is different from the set yarn tension and a recognition made by the brake control input judging means 260 that the actual brake control input has reached the limit.

The yarn speed measuring means 270 measures the actual yarn running speed. This yarn speed measuring means 270 comprises a speed detecting roller which is arranged in frictional contact with the surface of a layer of yarns which are wound on the warper's beam or drum, for example, and a pulse generator which outputs a pulse signal every rotation of the speed detecting roller.

The speed comparing means 280 compares the actual yarn running speed measured by the yarn speed measuring means 270 with the set running speed stored by the set speed storage means 212 in response to a recognition made by the brake control input judging means 260 that the actual brake control input has reached the limit.

The aforementioned yarn speed control means 290 comprises yarn speed increase means 291 and yarn speed reducing means 292. The yarn speed increase means 291 increases the yarn running speed in response to a recognition made by the speed comparing means 280 that the actual running speed is smaller than the set running speed. The yarn speed reducing means 292 reduces the yarn running speed in response to a recognition made by the speed comparing means 280 that the actual running speed is larger than the set running speed. The yarn speed control means 290 can be formed by a drive unit 9A for rotating or driving the warper's beam or drum 9, see FIG. 10. Such a drive unit is preferably able to wind the yarns on the warper's beam or drum at a constant speed and to change the speed in a continuous manner if needed for example, the drive unit can be formed by a mechanism having motor with a drive shaft coupled to the warper's beam through a continuous speed change gear. Another suitable drive mechanism may comprise an adjustable speed motor connected to a drive shaft of the warp beam or drum. Still another driven mechanism may comprise a driving drum contacting the warper's beam under pressure to rotate or drive the beam at a constant speed. The speed of the driving drum can be varied conventionally if needed.

Figure 5:
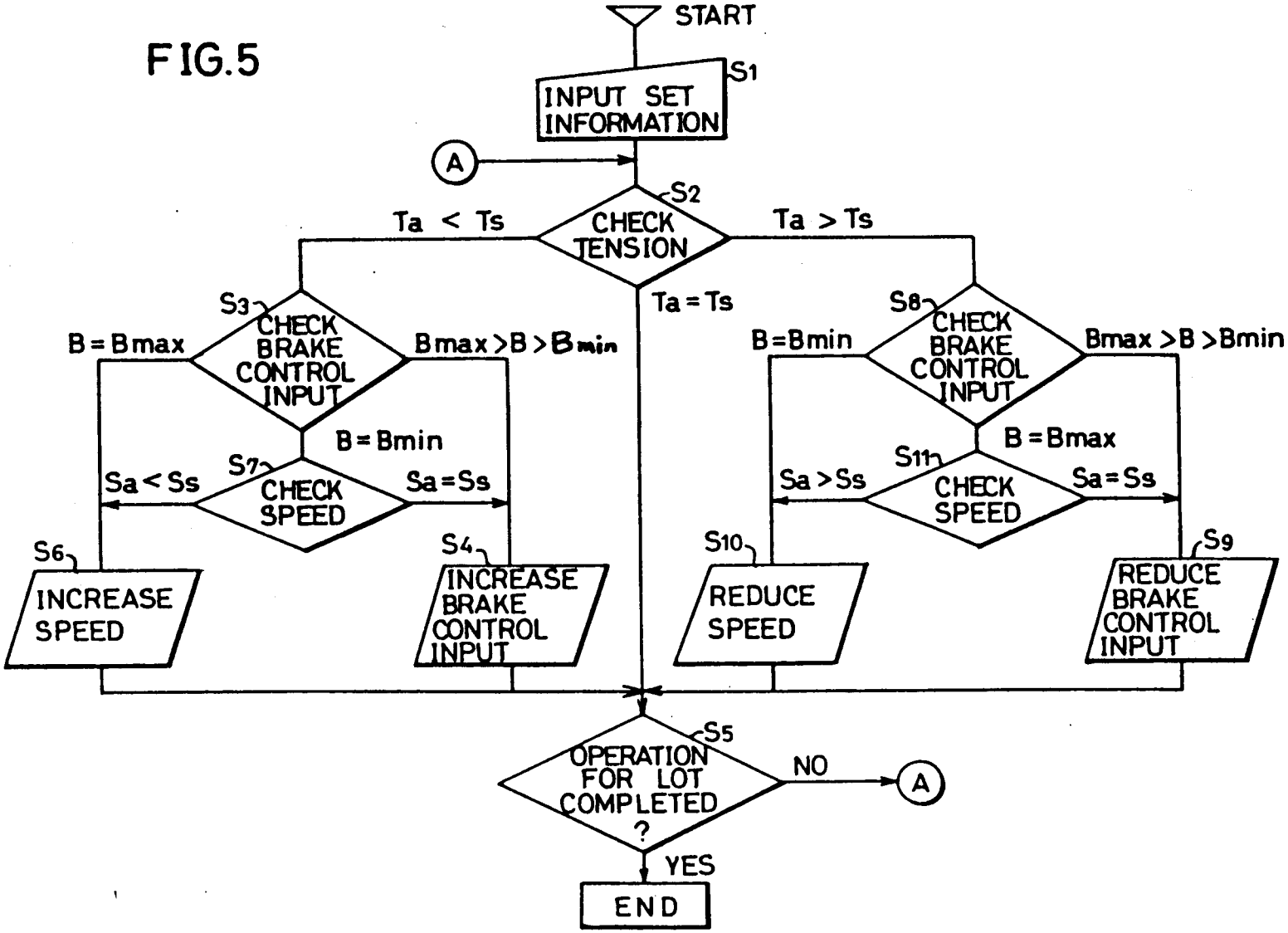
FIG. 5 is a flow chart showing an operation for controlling the yarn tension.

The operation of the tension controller will now be described with reference to FIGS. 4 and 5. Referring to FIG. 5, the symbol $T_s$ denotes the set yarn tension. The symbol $T_a$ denotes the actual yarn tension. The symbol $S_s$ denotes a set yarn. The symbol $S_a$ denotes the actual yarn. The symbol B denotes the actual brake control input. The symbol $B_{max}$ denotes the upper limit of the brake control input, and the symbol $B_{min}$ denotes the lower limit of the brake control input.

Before starting the warping operation, set information as to the number of yarns to be warped, the initial brake control input, the desired yarn tension $T_s$, the desired yarn speed $S_s$, and the like is inputted into the set or desired information storage means 210 (step S1) by the operator.

When the warping operation is started, the tension measuring means 220 measures the actual yarn tension $T_a$, and the tension comparing means 230 compares the actual yarn tension $T_a$ with the set yarn tension $T_s$ (step S2).

If the actual yarn tension $T_a$ is smaller than the set yarn tension $T_s$, a decision is made whether or not the actual brake control input B has reached the limit within the predetermined range (step S3).

If the brake control input B is within the predetermined range but has not yet reached the desired limit, the brake force increase means 241 increases the brake control input by the brake force supply means 250, to approach the actual yarn tension $T_a$ to the set yarn tension $T_s$ (step S4).

Thereafter, it is confirmed whether or not the warping operation for the current lot is completed (step S5). If the warping operation is not yet completed, the process returns to the step S2. If the warping operation for the lot is completed, the tension control is stopped.

If it is recognized at step S3 that the actual brake control input B has reached the upper limit $B_{max}$, the yarn speed increase means 291 increases the yarn running speed to conform the actual yarn tension $T_a$ to the set yarn tension $T_s$ (step S6).

If it is recognized at step S3 that the actual brake control input B has reached the lower limit $B_{min}$, on the other hand, the speed comparing means 280 compares the actual yarn speed $S_a$ with the set yarn speed $S_s$ (step S7). If the actual yarn speed $S_a$ is smaller than the set yarn speed $S_s$, the yarn speed increase means 291 increases the yarn speed (step S6). If it is recognized that the actual yarn speed $S_a$ is identical to the set yarn speed $S_s$, the brake force increase means 241 increases the brake control input by the brake force supply means 250 (step S4).

If it is recognized at step S2 that the actual yarn tension $T_a$ is larger than the set yarn tension $T_s$, a decision is made whether or not the actual brake control input B by the brake force supply means 250 has reached the limit of the predetermined range (step S8).

If it is recognized that the actual brake control input B is within the predetermined range but has not yet reached the desired limit, the brake force reducing means 242 reduces the brake control input B by the brake force supply means 250 to conform the actual yarn tension $T_a$ to the set or desired yarn tension $T_s$ (step S9).

If it is recognized at step S8 that the actual brake control input B has reached the lower limit $B_{min}$, the yarn speed reducing means 292 reduces the yarn running speed to conform the actual yarn tension $T_a$ to the set or desired yarn tension $T_s$ (step S10).

If it is recognized at step S8 that the actual brake control input B has reached the upper limit $B_{max}$, on the other hand, the actual yarn speed $S_a$ is compared with the set or desired yarn speed $S_s$ (step S11). If the actual yarn speed $S_a$ is larger than the set yarn speed $S_s$, the yarn speed reducing means 292 reduces the yarn running speed (step S10). If it is recognized that the actual yarn speed $S_a$ is identical to the set or desired yarn speed $S_s$, on the other hand, the brake control input by the brake force supply means 250 is reduced (step S9).

If it is recognized at the step S2 that the actual yarn tension $T_a$ is identical to the set or desired yarn tension $T_s$, it is confirmed whether or not the warping operation for the lot is completed (step S5).

Figure 6:
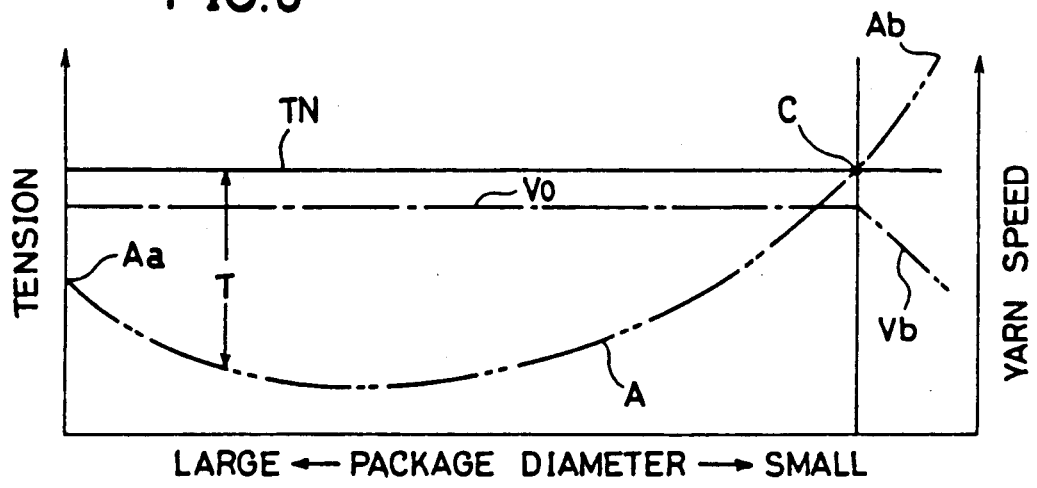
FIGS. 6, 7, 8 and 9 illustrate the relationships between the brake control input to the brake force supply means, the yarn running speed, and the set yarn tension.

Referring to FIG. 6, the horizontal axis shows the package diameter and the left vertical axis shows the yarn tension, while the right vertical axis shows the yarn running speed. The curve A shows the yarn tension which is measured when the brake control input to the brake force supply means 250 is zero and the yarn running speed is fixed at the set or desired speed $V_O$. The point $A_a$ shows a brakeless tension caused the release resistance of the yarn out of a full packages and the air resistance. The point $A_b$ shows a brakeless tension caused by the release resistance developed immediately before the packages are used up and the air resistance. The straight line $T_N$ shows the set or desired yarn tension, and the straight lines $V_O$ and $V_b$ show the actual yarn speeds. The letter T denotes the value of additional tension which is supplied to the yarns by operating the brake force supply means 250. In other words, the tension T is evaluated by subtracting the tension shown in the curve A from the set tension $T_N$.

In the state shown in FIG. 6, the set or desired yarn tension $T_N$ is lower than the maximum value $A_b$ of the brakeless tension A. The lower limit of the operation range is set at such a control input that the additional tension T supplied by the brake force supply means 250 is zero, while the letter C denotes the intersection between the straight line showing the set tension $T_N$ and the curve A showing the brakeless tension. Until the package diameter reaches the x-coordinate of the intersection C, i.e., until the brake control input by the brake force supply means 250 reaches the lower limit of zero, the tension T is added to the brakeless tension A by operating the brake force supply means 250, to provide the set or desired tension $T_N$. During this period, the yarn running speed shown in the right vertical line is maintained at the initial value $V_0$. When the curve A passes through the intersection C, i.e., when the package diameter is further reduced beyond the intersection C, the brakeless tension A exceeds the set tension $T_N$. Therefore, the additional tension T is fixed at the minimum value and the yarn running speed is reduced along the oblique line $V_b$, thereby maintaining the actual yarn tension at the set or desired tension $T_N$.

In the example shown in FIG. 6, the additional tension T applied by the brake force supply means 250 has such a wide variable range that its upper limit, i.e., the maximum additional tension, is larger than the difference between the set tension $T_N$ and the minimum value of the brakeless tension A. On the other hand, FIG. 7 shows an example wherein additional the tension T applied by the brake force supply means 250 has a narrow variable range.

Figure 7:
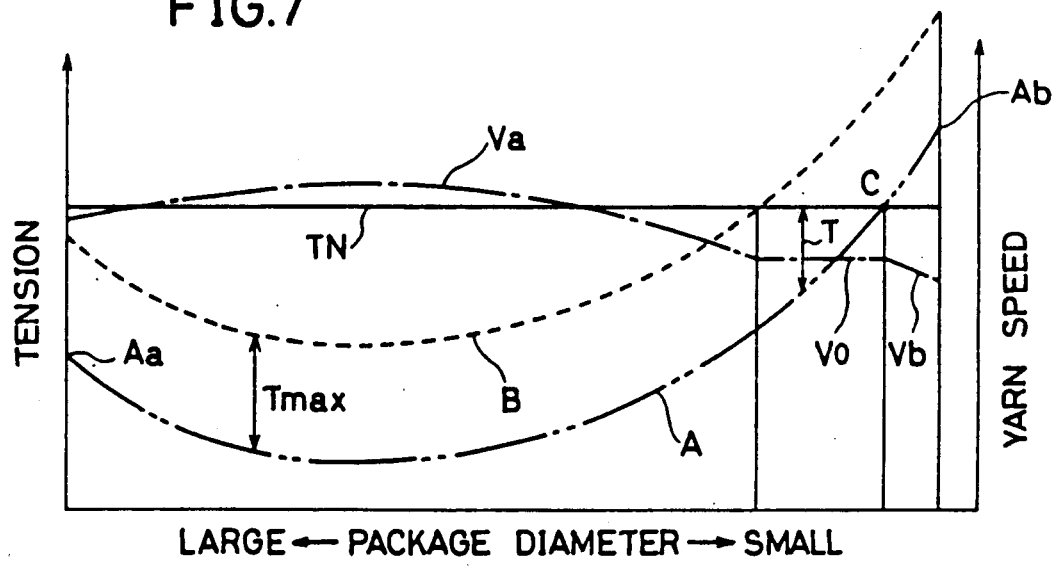

Referring to FIG. 7, $T_{max}$ denotes the maximum value within the variable range of the additional tension T which is applied by the brake force supply means 250. In the first half of FIG. 7 where the package diameter is still large, the total tension B of the brakeless tension A and the maximum additional tension $T_{max}$ is smaller than the set tension $T_N$. At this stage, the brake control input of the brake force supply means 250, i.e., the additional tension T, is fixed at the maximum value. The yarn running speed is increased from the initial value $V_0$ to follow an upwardly curved line $V_a$. As hereinabove described, the tension acting on the yarns is increased or decreased with an increase or decrease of the yarn running speed. Therefore, the total of the brakeless tension A, the maximum additional tension $T_{max}$ applied by the brake force supply means 250 and the tension which is increased or decreased with an increase or decrease of the yarn running speed is caused to conform to the set tension $T_N$, as shown in FIG. 7.

When the package diameter is reduced as the warping operation progresses, the total B of the brakeless tension A and the maximum additional tension $T_{max}$ applied by the brake force supply means 250 exceeds the set tension $T_N$. In this case, the yarn running speed is fixed at the initial value $V_0$ and the brake control input of the brake force supply means 250 is adjusted, as shown in FIG. 7. Thus, the actual yarn tension is caused to conform to the set tension $T_N$.

When the package diameter is further reduced, so that the brakeless tension A reaches the set or desired tension $T_N$ and the additional tension T applied by the brake force supply means 250 reaches zero at a point C, the yarn running speed is reduced along an oblique line $V_b$, to conform the actual yarn tension to the set tension $T_N$.

Figure 8:
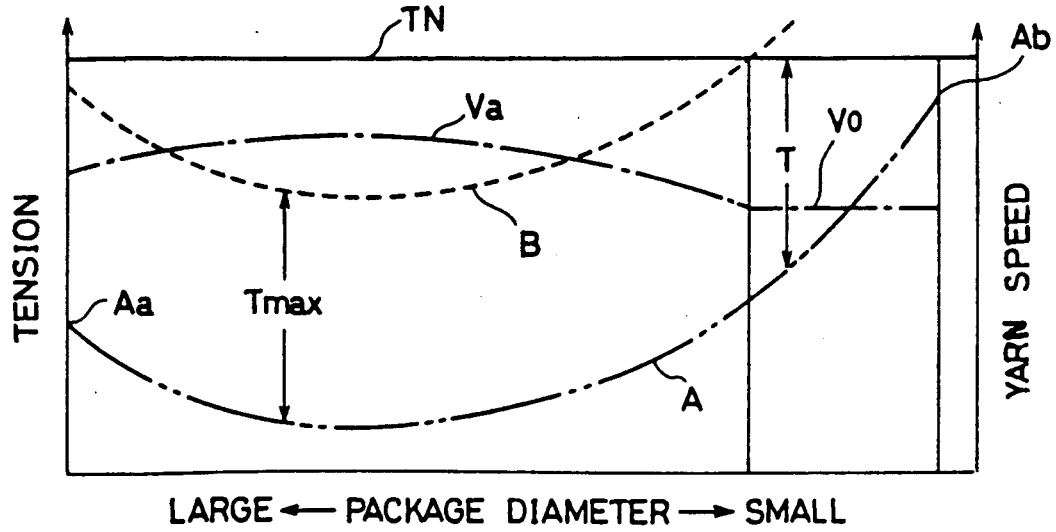

FIG. 8 shows an example of a warping operation of thick yarns. In order to warp thick yarns, the set or desired tension $T_N$ is so increased that the yarns are not loosened by their own weight. In the first half of FIG. 8 where the package diameter is still large, therefore, the total B of brakeless tension A and the maximum additional tension $T_{max}$ applied by the brake force supply means 250 has not yet reached the set or desired tension $T_N$. In this stage, the additional tension T supplied by the brake force supply means 250 is fixed at the maximum value $T_{max}$, and the yarn running speed is increased from its initial value $V_0$ to initially follow an upwardly curved line $V_a$. Thus, the actual yarn tension is caused to conform to the set tension $T_N$. When the package diameter is so reduced that the total tension B exceeds the set or desired tension $T_N$, i.e., when the total tension B enters the variable range of the additional tension T, the actual tension is maintained at the set or desired tension $T_N$ by controlling the additional tension T for fixing the yarn running speed at the initial value $V_0$.

Figure 9:
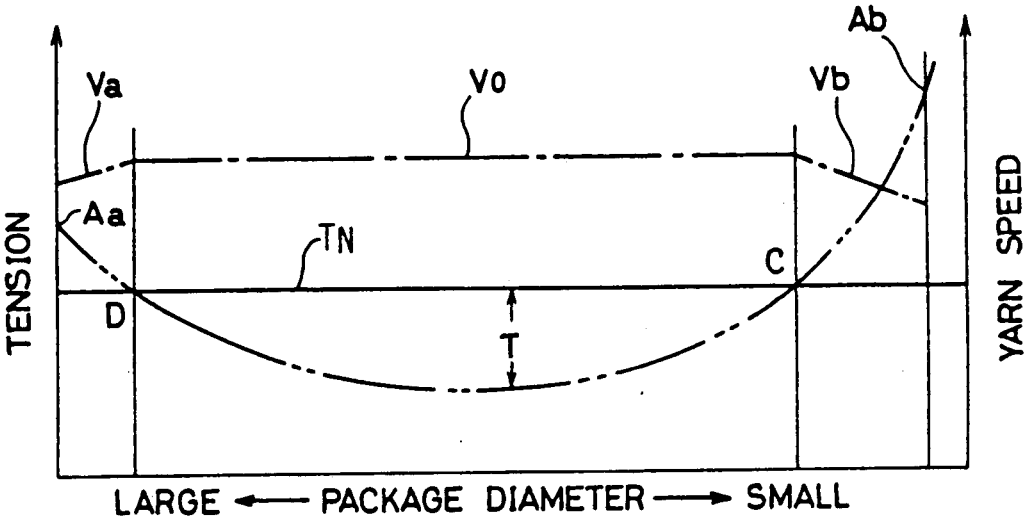

In the examples shown in FIGS. 6 to 8, the brakeless tension $A_a$, which is caused by the release resistance developed when the yarns are drawn out from a full packages at the set speed $V_0$ and the air resistance, is smaller than the set tension $T_N$. In an initial stage of a warping operation, however, the brakeless tension $A_a$ may be larger than the set or desired tension $T_N$, as shown in FIG. 9. In this case, the actual tension is caused to conform to the set tension $T_N$ by reducing the brake control input to the minimum value of zero and by increasing the yarn running speed along an oblique line $V_a$ up to a point D, i.e., until the brakeless tension A of the initial stage reaches the set or desired tension $T_N$. The initial speed of the yarns is smaller than the set or desired speed $V_0$. In the interval between the point D and a point C shown in FIG. 9, the yarn running speed is fixed at the set speed $V_0$, and the additional tension T is added to the brakeless tension A by operating the brake force supply means 250. The additional tension T is fixed at the minimum value of zero when the same passes through the point C, and the yarn running speed is reduced along another oblique line $V_b$.

Figure 11:
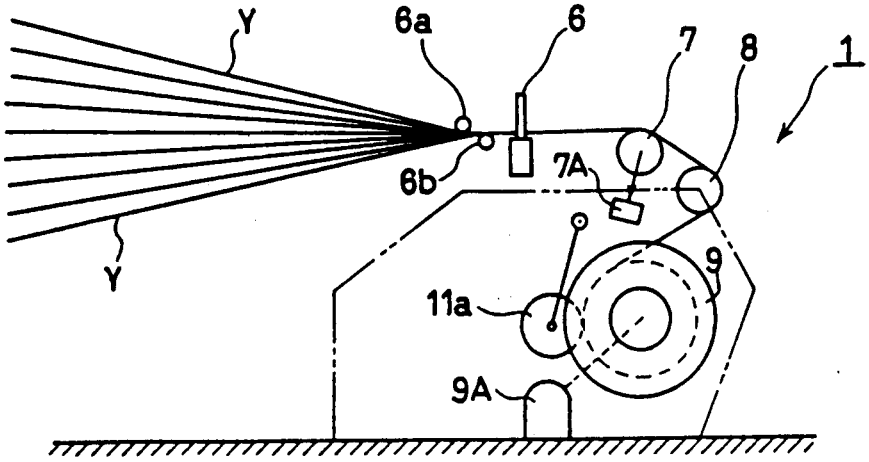
FIG. 11 is a side elevational view of the warping machine shown in FIG. 10.
Figure 10:
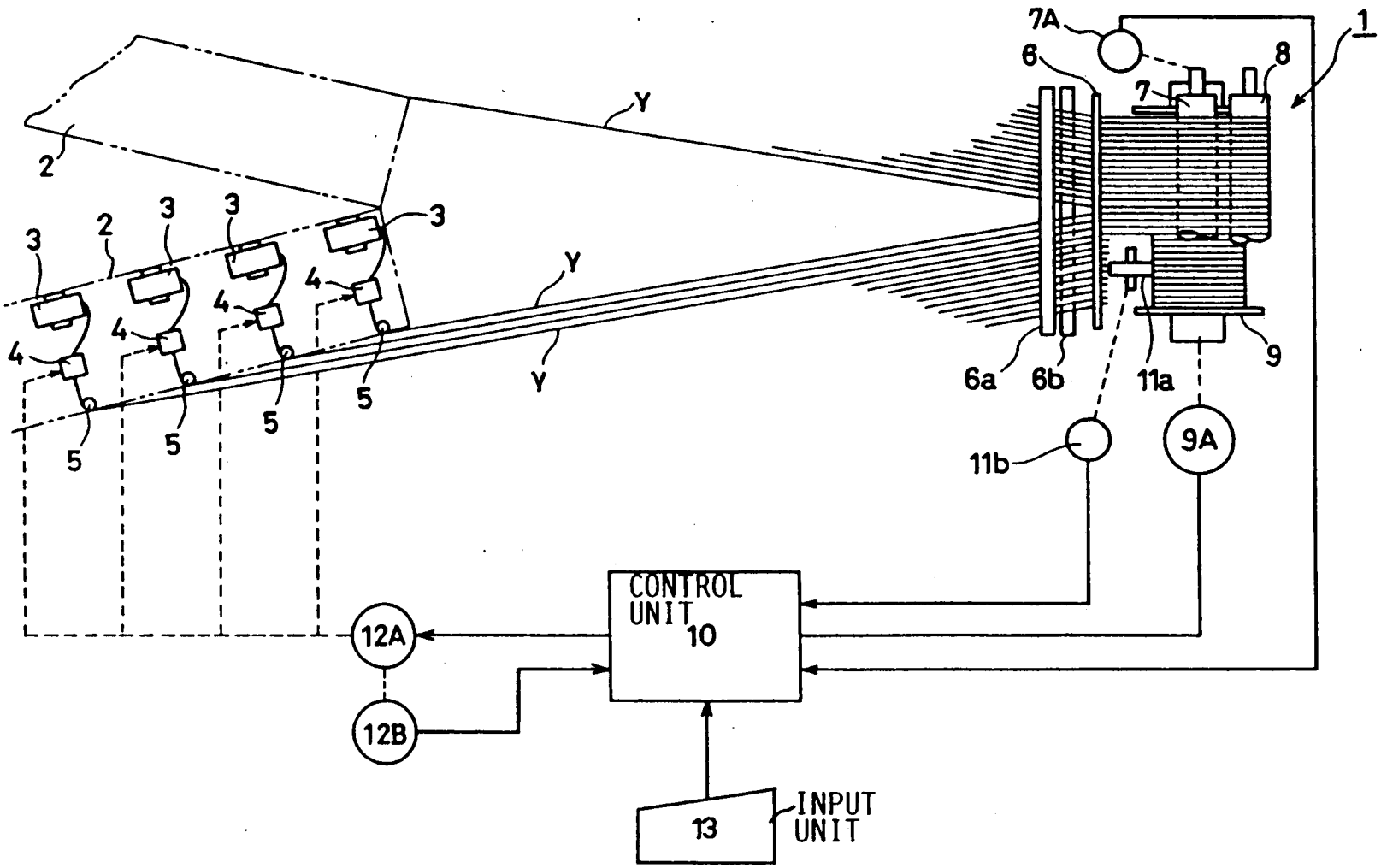
FIG. 10 is a schematic plan view showing an embodiment of the present invention.

FIGS. 10 and 11 illustrate the structure of the embodiment of an present invention, including a warping machine 1 and left and right creels 2. Each of the creels 2 is provided with a number of vertically and horizontally arranged packages 3. A number of yarns Y is drawn out from the number of packages 3 and the yarns are guided through yarn brake devices 4 and guide bars 5 toward guide rods 6a and 6b and a reed 6 of the warping machine 1. Thereafter the yarns Y are wound on a warper's beam 9 through a measuring roller 7 for detecting the tension and through a guide roller 8 for changing the running direction. Bearings not shown for supporting both ends of the measuring roller 7 are provided on a pressure sensor 7A, having an output connected to a control unit 10. A speed detecting roller 11a is arranged to be in frictional contact with the surface of a layer of the yarns wound on the warper's beam 9. A pulse generator 11b outputs a pulse signal for each revolution of the speed detecting roller 11a and transmits the pulse signal to the control unit 10.

A brake drive unit 12A for setting the brake control inputs of the yarn brake devices 4 and a brake detector 12B for detecting the control inputs are provided between the yarn brake devices 4 of the creels 2 and the control unit 10. Further, an input unit 13 such as a keyboard is provided in order to input set or desired values of the yarn tension, yarn speed and control inputs for the yarn brake devices 4 in the control unit 10, respectively. A drive unit 9A drives the warp beam 9.

Figure 12:
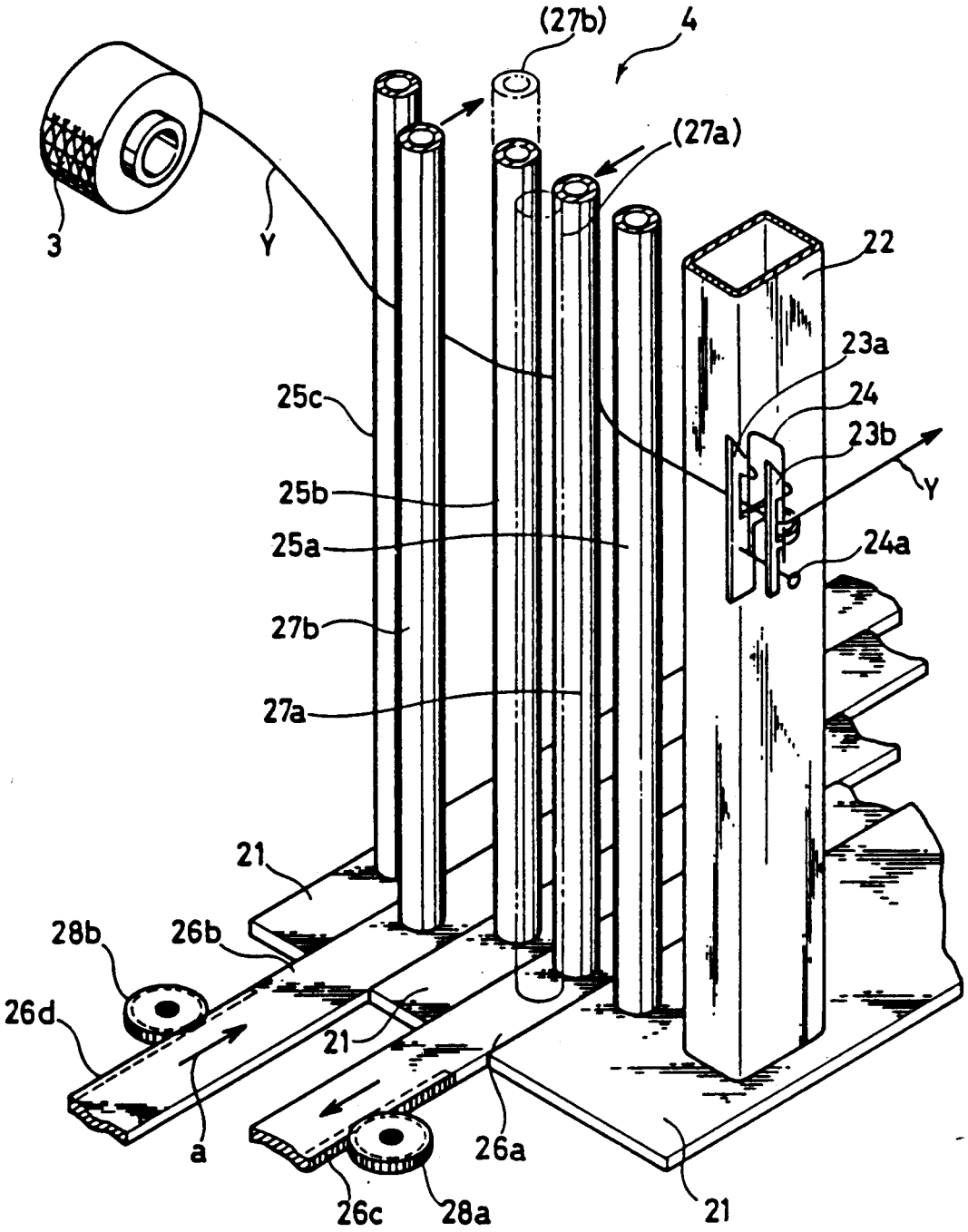
FIG. 12 is a perspective view showing an example embodying brake force supply means.

FIG. 12 shows an exemplary yarn brake device 4 which is provided in the creel 2. A hollow prismatic bar 22 is mounted on a front base plate 21 for every vertical column of a number of vertically and horizontally arranged packages 3. The bar 22 is provided on its front surface with a drop wire unit including two yarn hooks 23a and 23b and an inverted U-shaped drop wire 24, in correspondence to the package 3. When the warping machine is driven, the drop wire 24 is raised up by the yarn Y to hold the drop wire 24 in the upright state shown in FIG. 12. When the yarn Y is broken, the drop wire 24 is rotated downwardly counter clockwise about its lower end 24a. The bar 22 is provided in its interior with an electric contact, which is closed when the drop wire 24 falls due to breakage of the yarn Y, thereby stopping the operation of the warping machine 1.

At the back of the bar 22, first, second and third fixed tension bars 25a, 25b and 25c are mounted on the base plates 21, whereby these bars are spaced apart from each other. A first slide plate 26a is slidably arranged between the first and second fixed tension bars 25a and 25b. A first movable tension bar 27a is secured on the first slide plate 26a. A second slide plate 26b is also slidably arranged between the second and third fixed tension bars 25b and 25c, and a second movable tension bar 27b is secured on the second slide plate 26b. The upper ends of the tension bars 25a, 25b, 25c, 27a and 27b are supported by fixed and movable upper support plates, respectively but not shown.

The first slide plate 26a is provided on its end with a rack 26c, which engages with a pinion 28a. This pinion 28a is driven for rotation by a motor not shown, which corresponds to the brake drive unit 12A for controlling the yarn tension. The second slide plate 26b is also provided on its end with a rack 26d, which engages with a pinion 28b. This pinion 28b is driven for rotation by an air cylinder, not shown. As shown in FIG. 12, the first to third fixed tension bars 25a to 25c are positioned on one side of the running yarn Y, while the first and second movable tension bars 27a and 27b are positioned on the other side of the running yarn Y.

FIGS. 13A to 13E illustrate relationships between the running yarn Y and the tension bars. With reference to FIGS. 12 and 13A to 13E, the operation and function of the movable tension bars 27a and 27b will now be described.

Figure 13A:
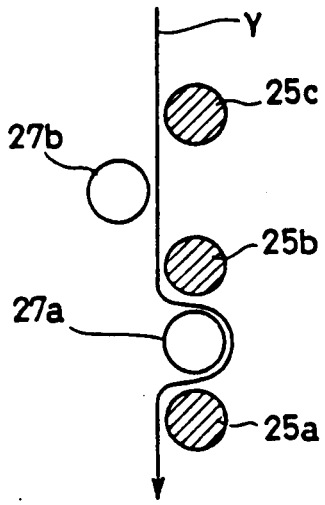
FIGS. 13A, 13B, 13C, 13D and 13E are schematic plan views illustrating the relationships between running yarns and brake force supply means respectively.
Figure 13B:
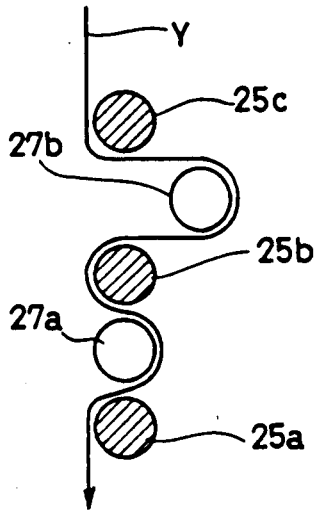

When the warping operation progresses in a normal manner, the first and second movable tension bars 27a and 27b are positioned as shown in FIG. 13A. When the warping machine 1 is stopped by breakage of the yarn or the like, the air cylinder drives the pinion 28b, to slidingly move the second slide plate 26b along an arrow a shown in FIG. 12. Consequently, the second movable tension bar 27b is brought from the position shown by solid lines to a position (27b) shown by phantom lines in FIG. 12. FIG. 13B shows this state. The second movable tension bar 27b pushes the yarn Y to extremely bend the same, thereby applying an excessive brake force to the yarn Y and preventing the same from following gravity also referred to as "inertial delivery". Japanese patent publication No. 61-275436 discloses a mechanism for preventing such "inertial delivery" of yarns.

Figure 13C:
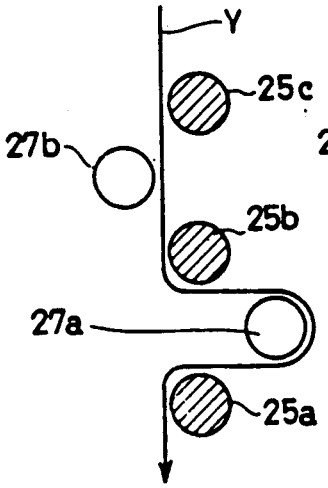
Figure 13D:
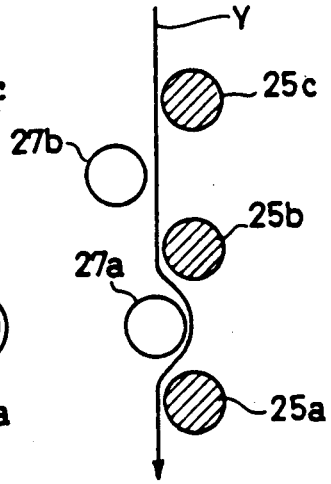
Figure 13E:
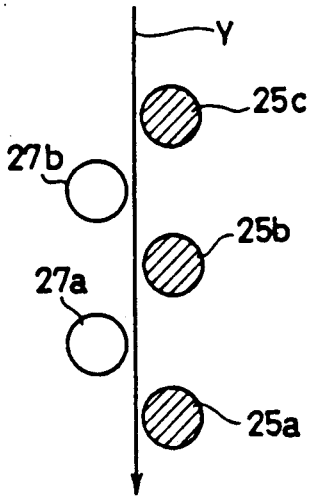

The first movable tension bar 27a adjusts the amount of pushing in response to a brake control input of the yarn Y with respect to the first and second fixed tension bars 25a and 25b, thereby adjusting the yarn tension during running. FIG. 13C shows a state wherein the first movable tension bar 27a responds to a large brake control input to supply a relatively large tension to the yarn Y. FIG. 13D shows a state wherein the first movable tension bar 27a responds to a relatively small brake control input to apply a relatively small tension to the yarn Y. On the other hand, FIG. 13E shows a state wherein the brake control input of the first movable tension bar 27a is zero, i.e., no tension is applied to the yarn Y.

Until the package diameter reaches the x-coordinate of the intersection C shown in FIG. 6, for example, the brake control input changes the position of the first movable tension bar 27a by a sliding movement of the first slide plate 26a, to apply additional tension T to the yarn Y. When the package diameter is reduced to reach the x-coordinate of the intersection C, the brake control input for moving the first movable tension bar 27a, reaches zero. FIG. 12 shows such a position of the first movable tension bar 27a in phantom lines, which corresponds to the state shown in FIG. 13E. The yarn Y runs linearly in this state. When the tension of the yarn Y is further increased beyond the set or desired tension, the first tension bar 27a stands still in the position shown in FIG. 13E. In order to conform the actual tension to the set or desired tension, the speed of rotation of a drive motor 9A is reduced thereby to decrease the circumferential speed of the warper's beam 9. Thus, an increase of the tension is prevented, to maintain a constant tension on the yarn Y.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A tension controller for a warping machine for maintaining a constant tension of running yarns during a warping operation wherein a number of yarns drawn out from a respective number of packages is symmetrically arranged and wound on a warper's beam or drum, said tension controller comprising:

brake force supply means (4, 250) for applying a brake force to said running yarns within a predetermined range of a brake control input for increasing yarn tension;

tension measuring means (220) for measuring an actual tension of said running yarns;

set tension storage means (211) for storing information representing a desired yarn tension;

tension comparing means (10, 280) for comparing said actual yarn tension measured by said tension measuring means with said desired yarn tension stored in said set tension storage means to provide a yarn tension difference signal;

brake control input judging means (260) for judging whether or not an actual brake control input to said brake force supply means has reached a limit within said predetermined range and to provide a respective brake control reference signal;

brake force control means (240) for controlling the value of said brake control input to said brake force supply means (4, 250) to remove a difference between said actual yarn tension and said desired yarn tension in response to said yarn tension difference signal provided by said tension comparing means and in response to said brake control reference signal signifying that said actual brake control input has not yet reached said limit; and yarn speed control means (9A, 10, 290) for controlling the running speed of said yarns to remove a difference between said actual yarn tension and said desired yarn tension in response to said yarn tension difference signal and in response to said brake control reference signal signifying that said actual brake control input has reached said limit.

2. The tension controller of claim 1, further comprising:

yarn speed measuring means (270) for measuring the actual running speed of yarns to provide an actual yarn running speed signal;

set speed storage means (212) for storing information representing a desired yarn running speed; and speed comparing means (280) for comparing said actual yarn running speed signal with said desired yarn running speed stored in said set speed storage means to provide a yarn speed difference signal in response to said brake control signal signifying that said actual brake control input has reached said limit, said yarn speed control means (290) comprising:

yarn speed increase means (291) for increasing said running speed of said yarns in response to said yarn speed difference signal signifying that said actual running speed is smaller than said desired running speed, and yarn speed reducing means (292) for reducing the running speed of said yarns in response to said yarn speed difference signal signifying that said actual running speed is larger than said desired running speed.

3. The tension controller of claim 2, wherein said brake force control means (240) comprises:

brake force increase means (241) for increasing said brake control input to said brake force supply means in response to said tension difference signal signifying that said actual tension is smaller than said desired tension, and brake force reducing means (242) for reducing said brake control input to said brake force supply means in response to said tension difference signal signifying that said actual tension is larger than said desired tension.

4. The tension controller of claim 3, wherein said brake force increase means (241) increases said brake control input to said brake force supply means in response to said brake control reference signal signifying that said actual brake control input has reached a lower limit and in response to an indication by said speed comparing means that said actual yarn running speed is identical to said desired running speed.

5. The tension controller of claim 3, wherein said brake force reducing means (242) reduces said brake control input to said brake force supply means in response to said brake control reference signal signifying that said actual brake control input has reached the upper limit and in response to said yarn speed difference signal signifying that said actual yarn running speed is identical to said desired running speed.

6. The tension controller of claim 1, wherein said yarn speed control means (290) comprises drive means for changing the speed of rotation of said warper's beam or drum in a continuous manner.

7. A warping method for systematically arranging a number of yarns drawn out from a respective number of packages and winding said yarns on a warper's beam or drum, said method comprising the steps of:

controlling an application of a brake force to running yarns for conforming an actual yarn tension to a predetermined desired yarn tension;

determining whether said brake force control alone achieves said conforming to provide a respective conforming or non-conforming signal, and additionally controlling the running speed of said yarns in response to said nonconforming signal signifying that said actual yarn tension cannot be conformed to said desired yarn tension only by said controlling of said brake force, thereby conforming said actual yarn tension to said desired yarn tension by a combined control of said brake force and of said running speed.

8. A warping method for systematically arranging a number of yarns drawn out from a respective number of packages and winding said yarns on a warper's beam or drum, comprising the steps of:

maintaining a constant yarn tension by supplying a brake force to said yarns while driving said yarns to run at a constant speed when diameters of said packages are relatively large, and maintaining a constant yarn tension by reducing said running speed of said yarns while supplying a zero or constant brake force to said yarns when diameters of said packages are relatively small.

9. A warping method for systematically arranging a number of yarns drawn out from a respective number of packages and winding said yarns on a warper's beam or drum, comprising the following steps:

maintaining a constant yarn tension by controlling the running speed of said yarns while applying a constant brake force to said yarns for increasing tension on said yarns when diameters of said packages are relatively large, and further maintaining a constant yarn tension by controlling said brake force applied to said yarns while causing said yarns to run at a constant speed when diameters of said packages are relatively small.

10. A warping method for systematically arranging a number of yarns drawn out from a respective number of packages and winding said yarns on a warper's beam or drum, comprising the following steps:

maintaining a constant yarn tension by controlling the running speed of said yarns while applying a constant brake force for increasing tension on said yarns in an initial stage when diameters of said packages are relatively large, maintaining a constant yarn tension by controlling a brake force applied to said yarns while causing said yarns to run at a constant speed in an intermediate stage of yarn package filling status, and maintaining a constant yarn tension by controlling the running speed of said yarns while applying a constant brake force for increasing tension on said yarns in a final stage where diameters of said packages are relatively small.

* * * * *